US009457215B2

(12) United States Patent
Schaub

(10) Patent No.: US 9,457,215 B2
(45) Date of Patent: Oct. 4, 2016

(54) DIVING BOARD FOR USE ON A BOAT

(71) Applicant: Corey L Schaub, Traverse City, MI (US)

(72) Inventor: Corey L Schaub, Traverse City, MI (US)

( * ) Notice: Subject to any disclaimer, the term of this patent is extended or adjusted under 35 U.S.C. 154(b) by 13 days.

(21) Appl. No.: 14/337,725

(22) Filed: Jul. 22, 2014

(65) Prior Publication Data

US 2015/0027360 A1 Jan. 29, 2015

Related U.S. Application Data

(60) Provisional application No. 61/857,504, filed on Jul. 23, 2013.

(51) Int. Cl.

| | |
|---|---|
| ***A63B 5/10*** | (2006.01) |
| ***A63B 21/02*** | (2006.01) |
| ***A63B 21/00*** | (2006.01) |
| ***A63B 21/008*** | (2006.01) |
| *B63B 27/00* | (2006.01) |
| *B63B 29/20* | (2006.01) |

(52) U.S. Cl.

CPC ..... *A63B 5/10* (2013.01); *A63B 21/0083* (2013.01); *A63B 21/023* (2013.01); *A63B 21/158* (2013.01); *A63B 2210/50* (2013.01); *A63B 2225/093* (2013.01); *B63B 27/20* (2013.01); *B63B 29/20* (2013.01)

(58) Field of Classification Search

CPC .... A63B 2244/203; A63B 5/10; A63B 5/08; B63B 29/20

USPC ..... 482/30–32

See application file for complete search history.

(56) References Cited

U.S. PATENT DOCUMENTS

| | | | | |
|---|---|---|---|---|
| 2,977,119 | A | 3/1961 | Lehfeldt et al. | |
| 3,300,209 | A | 1/1967 | Friis | |
| 3,342,483 | A * | 9/1967 | Erickson | A63B 5/10 482/31 |
| 3,371,928 | A * | 3/1968 | Buddo | A63B 5/10 267/154 |
| 3,450,404 | A * | 6/1969 | Nightingale | A63B 5/10 267/64.13 |
| 4,423,698 | A | 1/1984 | Peluso | |
| 6,981,463 | B1 * | 1/2006 | Aichele | B63B 21/56 114/218 |
| 2006/0278154 | A1 * | 12/2006 | Towley, III | B63C 13/00 114/264 |
| 2007/0123392 | A1 | 5/2007 | Hagerty | |
| 2012/0083390 | A1 | 4/2012 | Isaacson et al. | |

OTHER PUBLICATIONS

Notification of Transmittal of the International Search Report and the Written Opinion of the International Searching Authority, or the Declaration dated Nov. 7, 2014 for International Application No. PCT/US2014/047591 (13 pages).

* cited by examiner

*Primary Examiner* — Andrew Polay
(74) *Attorney, Agent, or Firm* — Taylor IP, P.C.

(57) ABSTRACT

A boat including a frame and a diving board mounted to the frame. The diving board includes a base and a board coupled to the base at a pivot location. The board extends from the pivot location to a distal end. An axial spring is interconnected between the base and the board for cancelling out forces which are imparted by a user jumping on the board at the distal end.

15 Claims, 10 Drawing Sheets

DIVING BOARD FOR USE ON A BOAT

CROSS REFERENCE TO RELATED APPLICATIONS

This is a non-provisional application based upon U.S. provisional patent application Ser. No. 61/857,504 entitled "DIVING BOARD FOR USE ON A BOAT", filed Jul. 23, 2013, which is incorporated herein by reference.

BACKGROUND OF THE INVENTION

1. Field of the Invention

The present invention relates to diving boards for use while swimming.

2. Description of the Related Art

Conventional diving boards typically include a fixed base which is mounted to an immovable object, such as the concrete decking surrounding a pool. The board itself is then mounted to the top of the fixed base in a cantilevered manner such that one end of the board extends a predetermined distance away from the base, and over the water. The resilient properties of the material from which the board is made (e.g., fiberglass), allow the board to flex to a limited extent and propel the swimmer out into the water.

The road block for years in designing and manufacturing a diving board for boats is that traditional diving board designs exert incredible forces on the frame to which they are installed, in this case, resulting in a violent shaking of the vessel (the term "frame" as used herein is intended to mean any type of structural component of a boat, such as a hull, structural members, flooring, pontoon tubes, etc.). The pressures created using a fixed mounting system on a conventional diving board are directly reflected by the weight of the person jumping. For example, if a 200 pound person jumps on the end of the 30" board, it will create up to 2,400 pounds of pressure at the first fixed mounting point. In the case of a pontoon boat, the board would be mounted to the flooring and frame which would not be able to withstand this type of force.

What is needed in the art is a diving board which may be mounted to a boat and used without substantial movement of the boat or forces being imparted on the structural framework of the boat.

SUMMARY OF THE INVENTION

The diving board of the present invention provides an "energy canceling" diving board, designed specifically for mounting to a boat. The diving board is configured such that downward forces generated by a person jumping on the end of the board are "canceled" by equal and opposite forces within its framework. The result is a much more stable boat.

The invention in one form is directed to a boat including a frame and a diving board mounted to the frame. The diving board includes a base and a board coupled to the base at a pivot location. The board extends from the pivot location to a distal end. An axial spring is interconnected between the base and the board for cancelling out forces which are imparted by a user jumping on the board at the distal end.

The invention in another form is directed to a diving board including a base and a board coupled to the base at a pivot location. The board extends from the pivot location to a distal end. An axial spring is interconnected between the base and the board for cancelling out forces which are imparted by a user jumping on the board at the distal end.

An advantage of the present invention is a user can enjoy diving from a boat without compromising the boat's stability. Without this invention, the occupants in a boat are disturbed as a result of the unsteadiness experienced when a person jumps off a boat into the water, as the boat rather abruptly moves up and down in the water. The invention cancels out the effects of a person jumping and provides for a more enjoyable and steady boating experience.

Another advantage of the present invention is the diving board can be easily folded down into a stowed position. This lets the boat be transited and docked without damaging the diving board and/or the boat. As a byproduct of being easily stored, it can be easily and conveniently raised when ready for use.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention, in one form, and such exemplification is not to be construed as limiting the scope of the invention in any manner.

DESCRIPTION OF THE INVENTION

Figure 1:
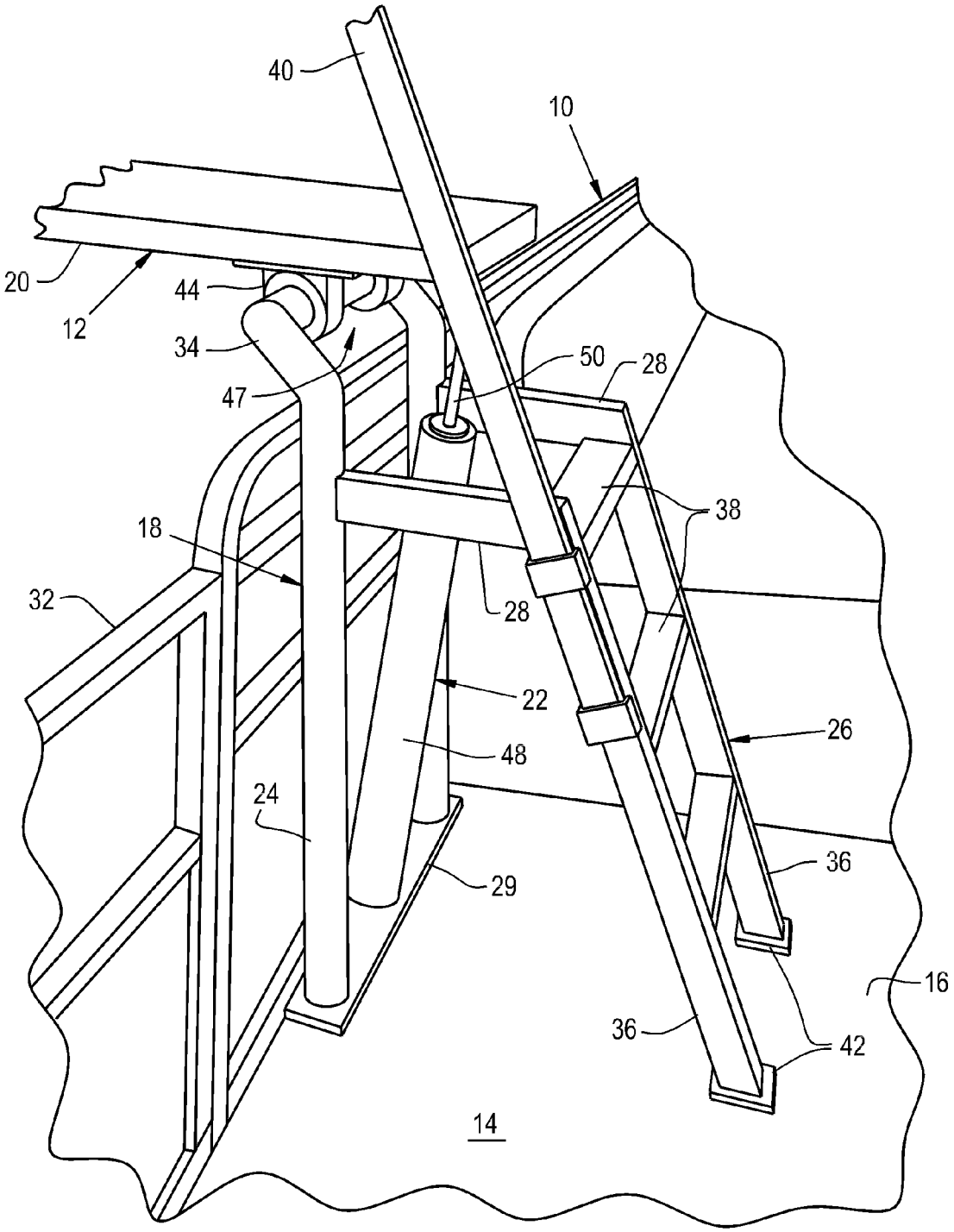
FIG. 1 is a side perspective view of an embodiment of the diving board of the present invention.

Referring now to the drawings, and more particularly to FIGS. 1-7, there is shown a boat 10 to which is mounted an embodiment of a diving board 12 of the present invention. Boat 10 includes a frame 14, which is generally defined to include any supporting structure to which the diving board 12 may be mounted. For example, the frame 14 may include flooring 16, or a hull, structural members, pontoon tubes, etc. (not shown).

Diving board 12 generally includes a base 18, a board 20 and an axial spring 22. Base 18 includes generally upright supports 24, steps 26 positioned rearwardly from upright supports 24, and cross members 28 interconnecting the upright supports 24 with steps 26. A mounting plate 29 interconnects between the bottom ends of upright supports 24, and includes holes or the like through which fasteners may be inserted to fasten diving board 12 to the frame 14 of boat 10. A tube 30 interconnects the upright supports 24 and provides a pivot surface at its outer circumference about which the board 20 can be pivoted to a stowed position lying alongside the railing 32 of the boat 10 (see FIG. 6). At the top end of upright supports 24 there are outwardly extending stub members 34 which position tube 30 such that board 20 can be pivoted to the stowed position alongside the railing 32.

Figure 5:
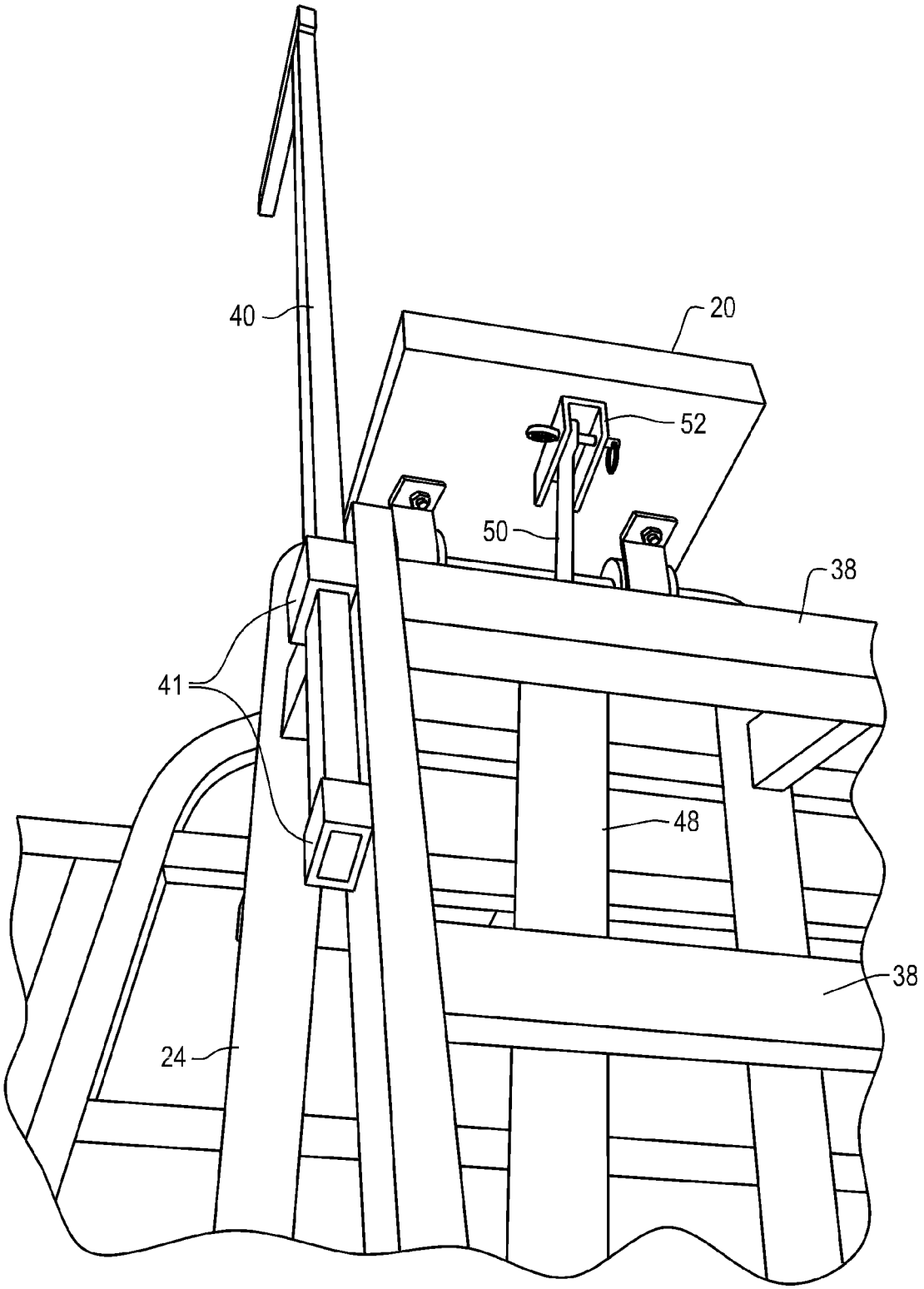
FIG. 5 is a bottom perspective view of the diving board shown in FIG. 1.
Figure 7:
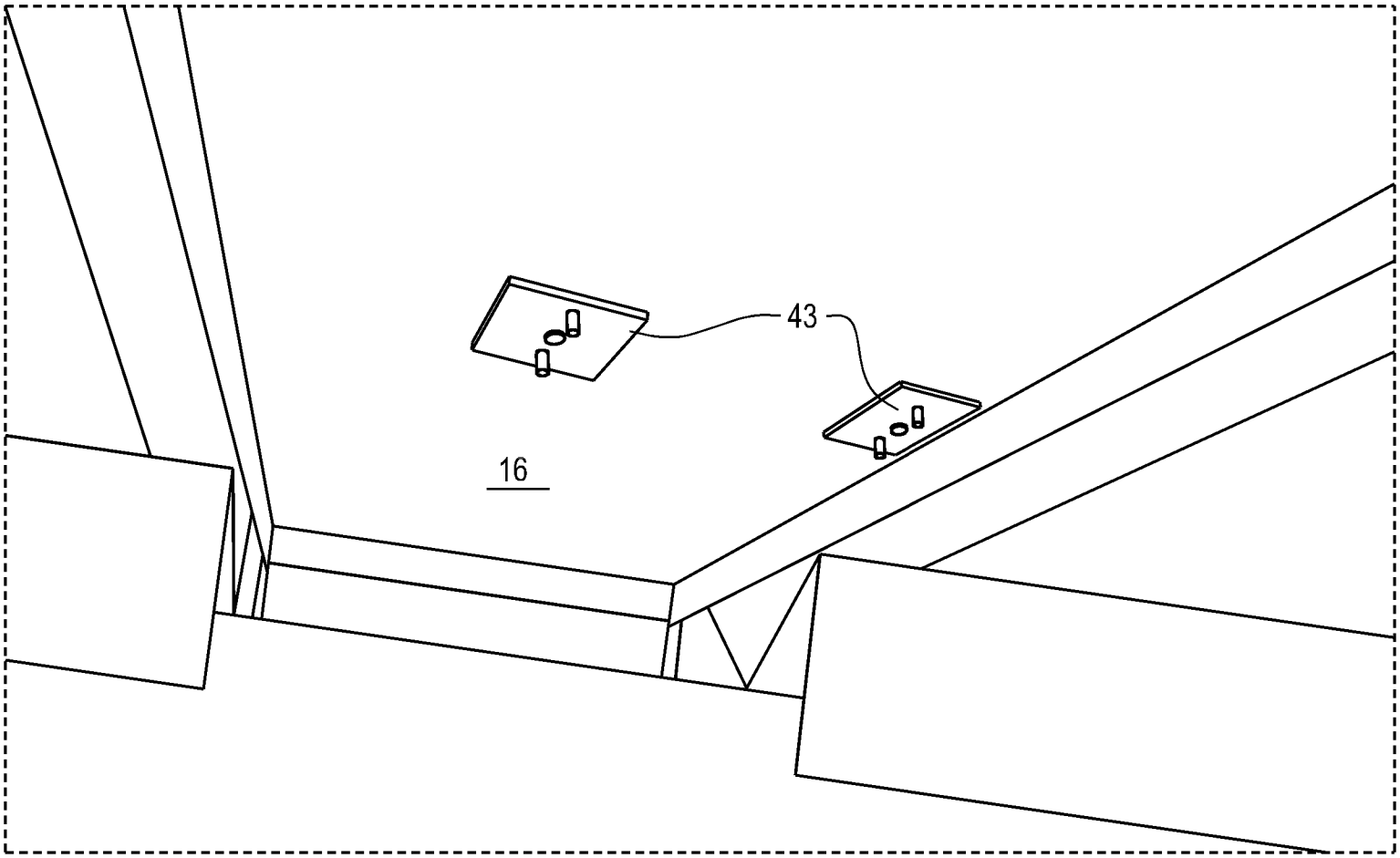
FIG. 7 is a bottom perspective view showing the reinforcement plates below the flooring of the boat shown in FIG. 1.

Steps 26 include a pair of generally vertical side rails 36 and horizontal treads 38. A handrail 40 is adjustably connected by a sleeve 41 on one of the side rails 36 to allow for height adjustments for different swimmers (FIG. 5). A pair of mounting plates 42 are respectively positioned at each bottom end of the side rails 36 to provide a larger surface area in contact with flooring 16, and include holes or the like through which fasteners may be inserted to fasten diving board 12 to the frame 14 of boat 10. Reinforcement plates 43 are positioned at the bottom side of the flooring 16, and have threaded holes through which the fasteners extending through the holes in the mounting plates 42 may be threaded (FIG. 7). In circumstances when it is not advantageous to use mounting plates 42 at the bottom side of the flooring 16, for example if it is difficult to access the underside of the boat frame or swim platform, the diving board 12 can be attached to the frame 14 via top surface mounting plates (not shown).

Base 18 is made entirely of aluminum in the illustrated embodiment, but could be made from a different material depending upon the application (e.g., steel, fiberglass, wood, etc.).

Figure 6:
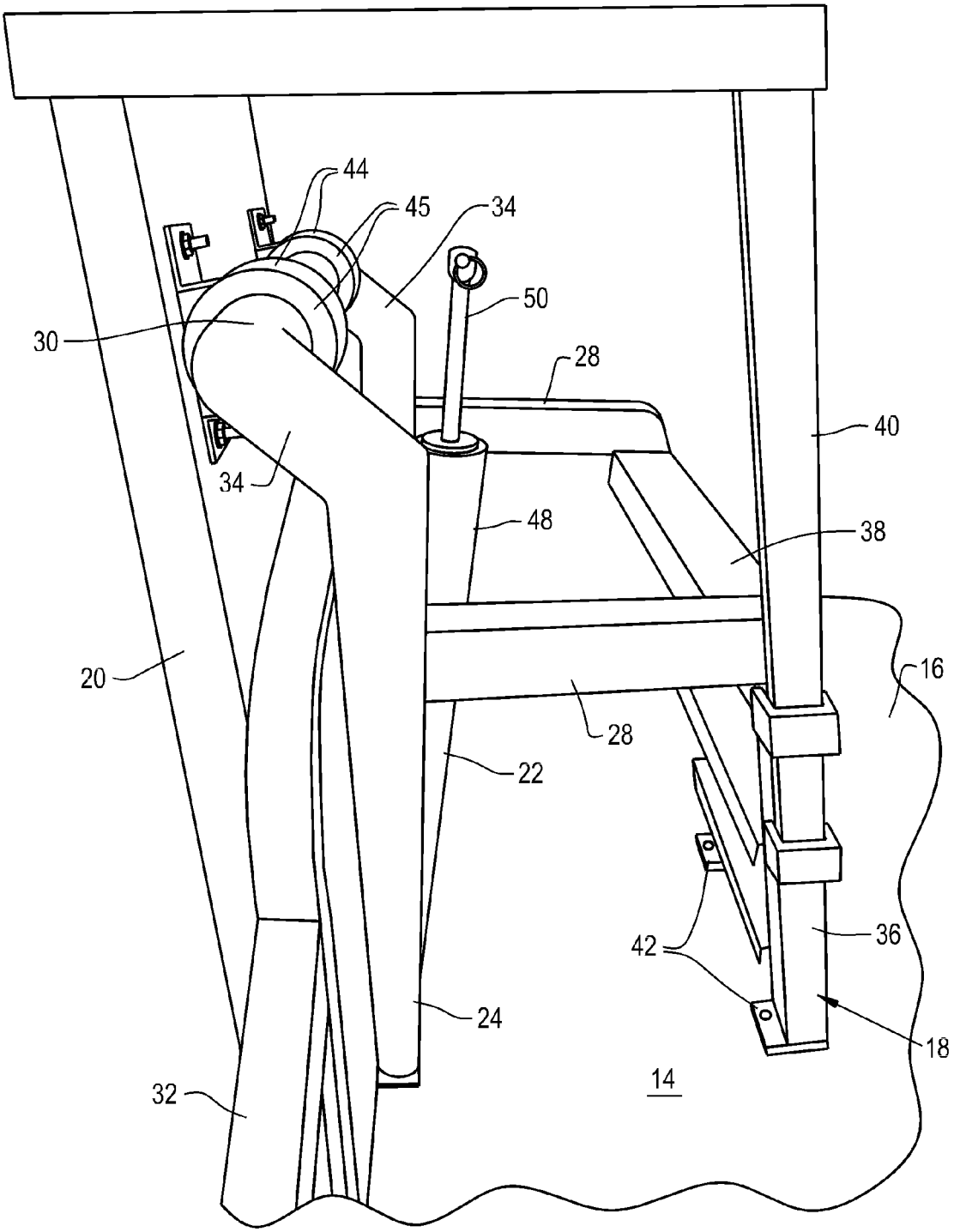
FIG. 6 is a side perspective view showing the board in a folded state alongside the railing of the boat shown in FIG. 1.

Board 20 is coupled to base 18 via a pair of couplers 44 with plastic bearings 45, which pivot about tube 30 (FIG. 6). Couplers 44 are preferably configured as bushings with a friction reducing liner material at the inside diameter, such as nylon or Teflon®, but could also be configured without the liner or with a bearing. Board 20 extends outwardly a predefined distance from the pivot location 47 defined by tube 30 to a distal end 46 from which a swimmer jumps. In the illustrated embodiment, the overall length of board 20 is approximately 38 inches, with 30 inches extending outwardly from the pivot location 47.

Figure 8:
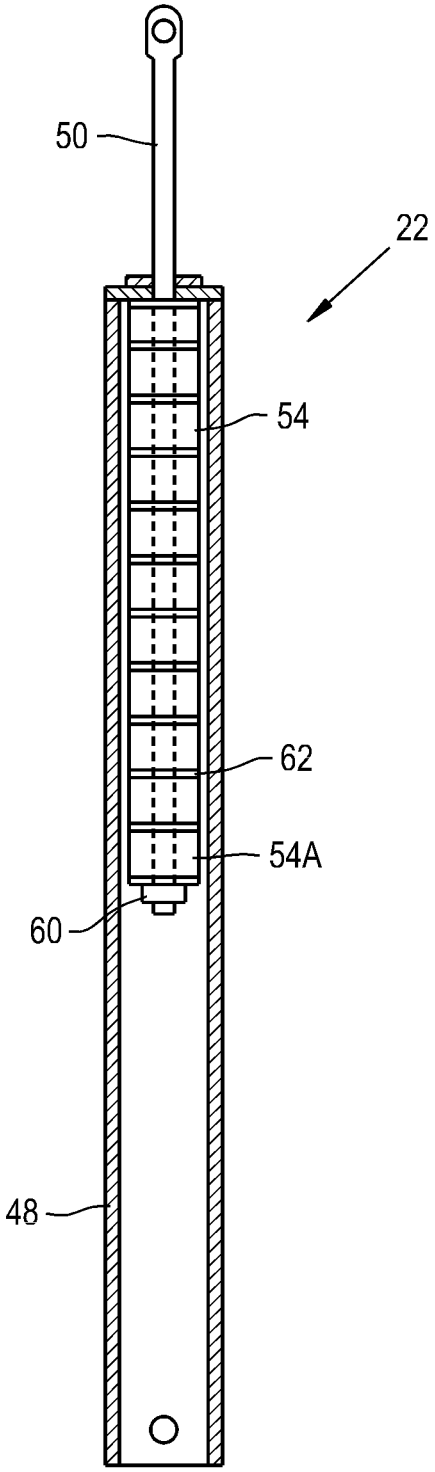
FIG. 8 is a side cross-sectional view of the axial spring shown in FIGS. 1-6.
Figure 9:
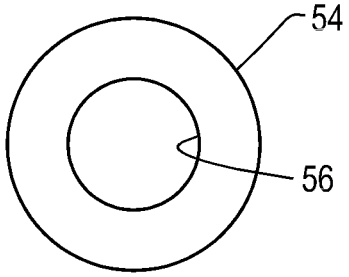
FIG. 9 is a top view of a urethane disk.

Axial spring 22 is interconnected between base 18 and board 20 for canceling out forces which are imparted by a user jumping on board 20 at distal end 46. Axial spring 22 includes a cylinder 48 containing a urethane spring assembly with a plurality of urethane disks 54 with a central opening 56 separated by washers 62 (FIGS. 8 and 9). The washers 62 can be made of any suitably strong material such as stainless steel or aluminum. The stack of urethane disks, functioning as a spring, are designed to complement steel wire springs where such conditions as confined space; corrosion, vibration and magnetism prevent the use of conventional steel springs. Urethane spring material is a polyether-elastomer that reacts similarly to an incompressible fluid. As such, urethane springs bulge when compressed, and the inside diameter of cylinder 48 is sized to accommodate such bulging. The bottom end of cylinder 48 is connected to the mounting plate 29 at an approximate mid-location between the upright supports 24. A rod 50 extends from the top of cylinder 48. The bottom end of rod 50 extends through the central openings 56 of the urethane disks, creating a stack of urethane disks with a threaded nut 60 at the bottom end of the rod 50 adjacent the bottom urethane disk 54A. The top end of the rod 50 is connected to the upper shock mount 52 on the board 20. Although axial spring 22 is shown as including an internal urethane spring assembly as described above, it is also possible that axial spring 22 can be differently configured. For example, the axial spring 22 can be configured as a coil spring (compression or tension) or a gas spring.

Figure 2:
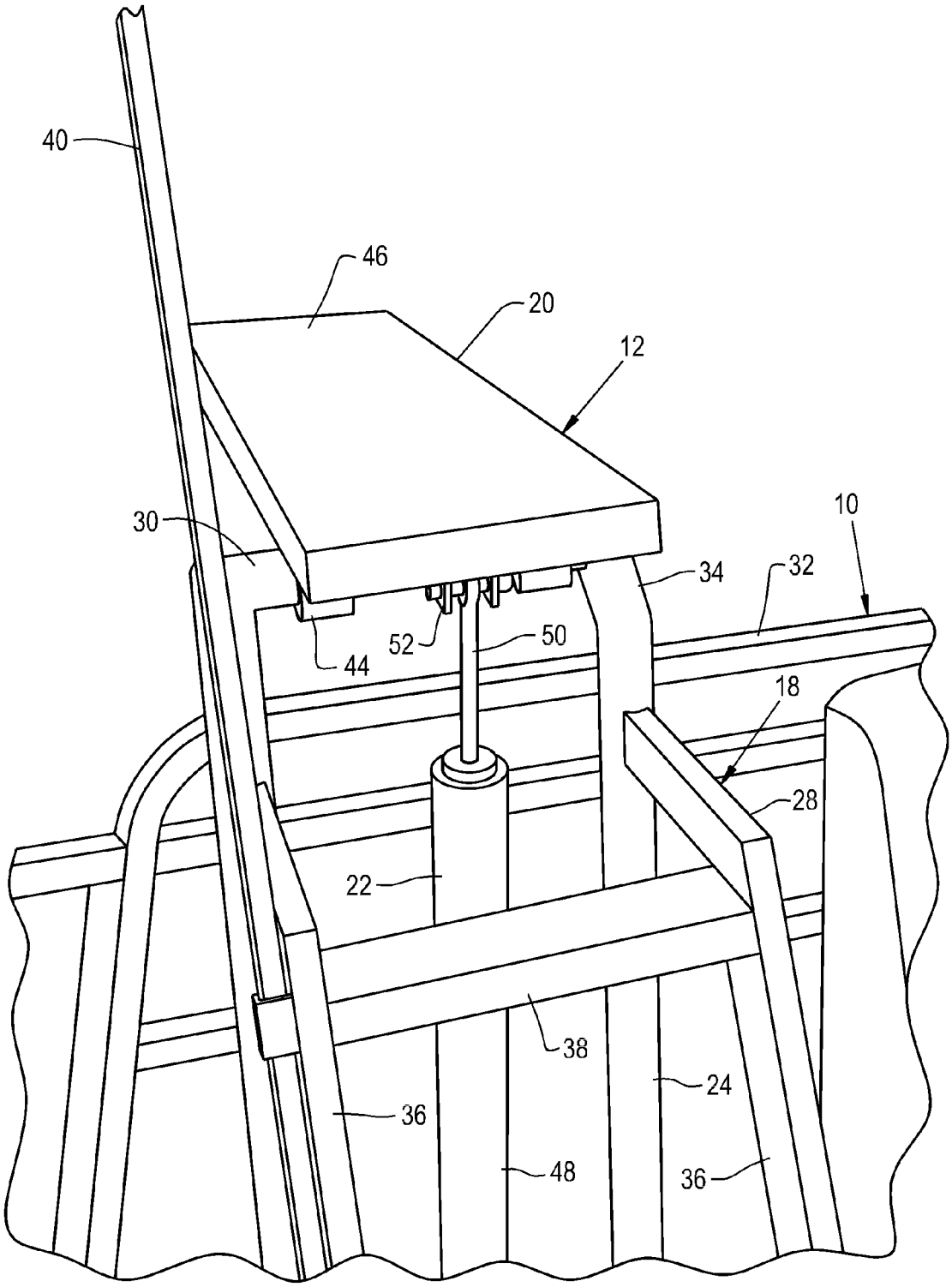
FIG. 2 is a rear perspective view of a portion of the diving board shown in FIG. 1.
Figure 3:
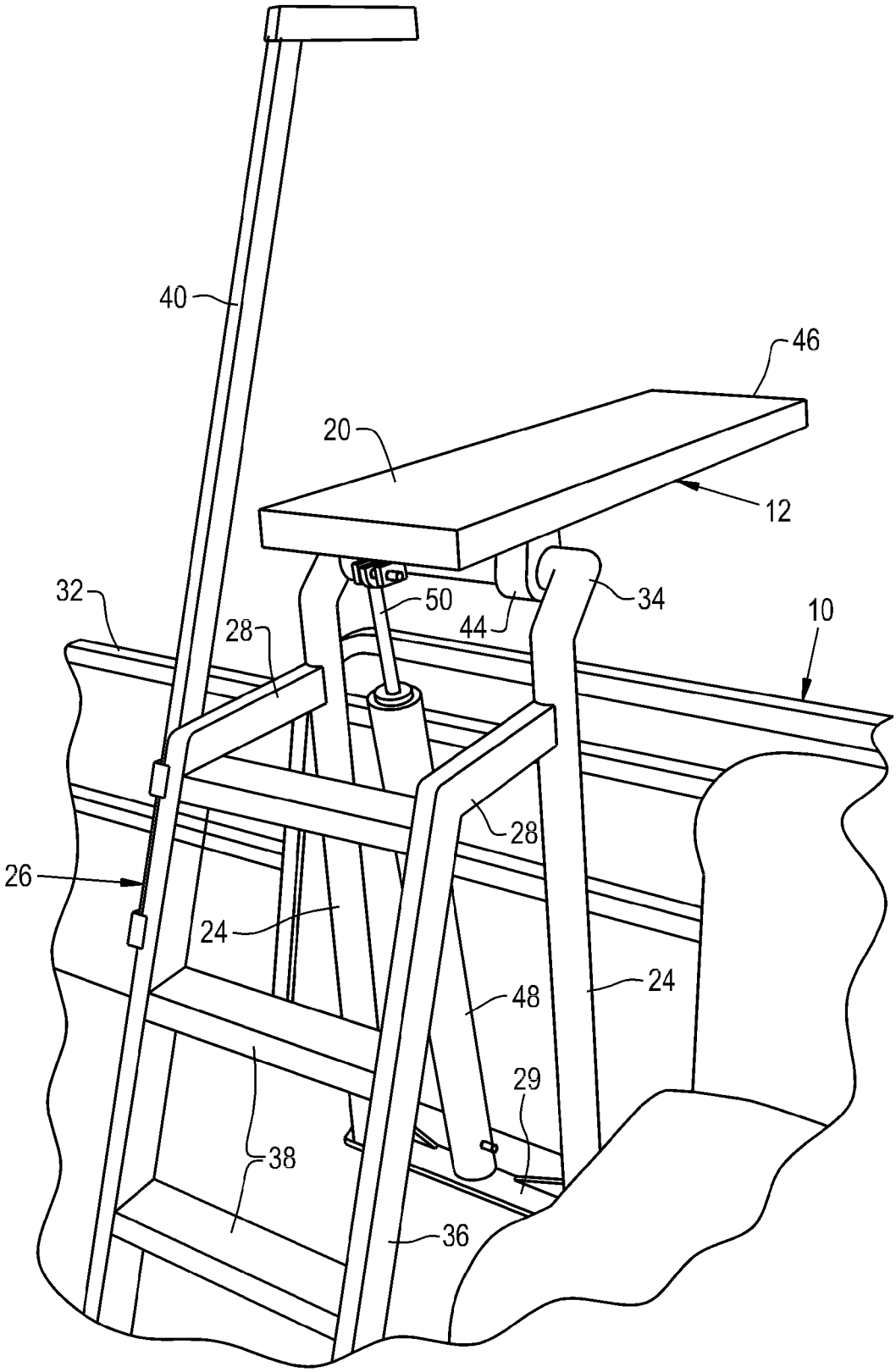
FIG. 3 is a perspective view of the diving board shown in FIG. 1.
Figure 4:
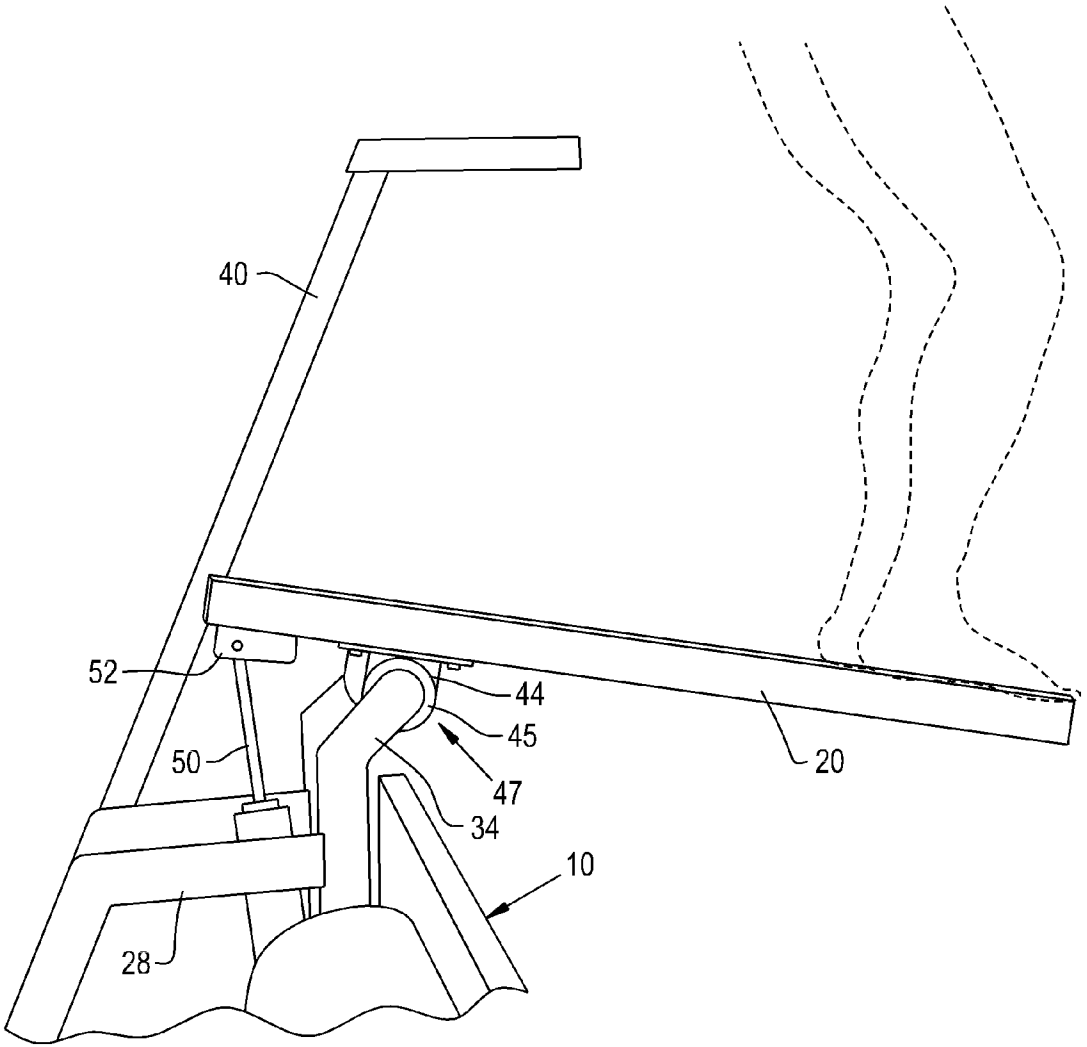
FIG. 4 is a side view of the diving board shown in FIG. 1 with a swimmer at a distal end of the board preparing to jump into the water.

During use, the diving board 12 of the present invention captures the energy created by the person jumping on the end of the diving board in the following process. The construction may be visualized by thinking of a "V". The left side of the "V" is the upright supports 24 with the pivot location 47 at the top, and the right side is the axial spring 22. Across the top is the board 20 with 30" in front of the pivot location 47 and 8" behind the pivot location. It connects to the compression spring via a pin at the upper shock mount 52 attached at the end of the board 20 (FIG. 2). The amount of force created and contained varies drastically depending on the weight of the person and how hard they push on the board when jumping.

The forces are transmitted from the board into the left side of the "V" which directs the force down the upright supports 24 to the bottom of the "V". Before it is transmitted into the boat, it is counteracted by the equal forces being "pulled" through the axial spring 22. This drastically reduces the force felt by the boat.

Utilizing a strong set of steps 26 the V-configuration is stabilized and kept in the upright position. The steps 26 are also utilized in the design process to "pull up" on the boat when the person jumps off the board. This helps counteract the motion created simply due to the weight of the person leaving the boat. Thus, the total force experienced by the remaining boaters is roughly equivalent to the "jumper" simply stepping off the boat.

The diving board 12 of the present invention is designed to get the jumper up and over the side railing 32 of the boat, which positions them roughly 4-5' above the water. The person climbs 3 steps, with a stabilizer bar or handrail 40 on one side, to get to the 38" aluminum diving board 20. However, the diving board 12 may be altered to have a taller base 18 with more than 3 steps to accommodate a larger vessel and/or higher guard railing.

In addition to the functionality, the diving board of the present invention may optionally be lowered or folded into a vertical stowed position by pulling the pin connecting the compression spring to the board—this nests the board next to the side railing of a pontoon boat, which allows the boat to dock normally without the diving board protruding from the side of the vessel (FIG. 6).

The diving board of the present invention includes an easy to remove mounting system which allows the entire diving board to quickly and easily be removed, broken down and stowed.

The diving board of the present invention utilizes quality components, welded construction, traction materials, and a handrail 40 which provide families with years of safe enjoyment.

The diving board of the present invention is built to last. Designed with heavy wall aluminum extrusions, stainless steel hardware and urethane spring components. The effects of corrosion and component failure are absolutely minimal.

Figure 11:
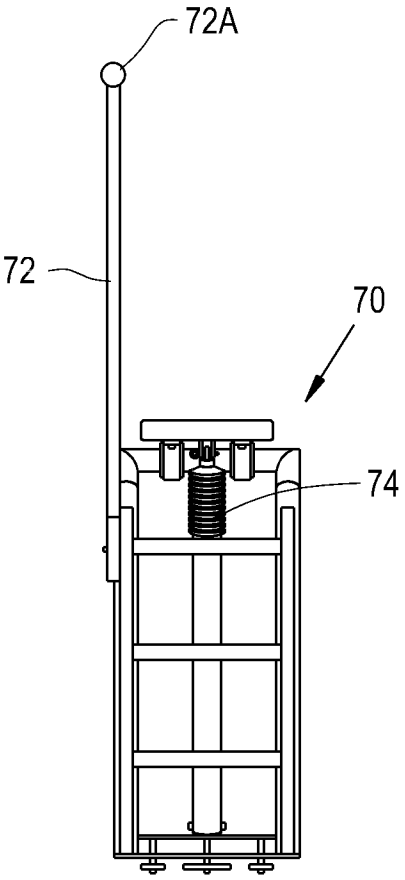
FIG. 11 is a side view of the diving board shown in FIG. 10.
Figure 10:
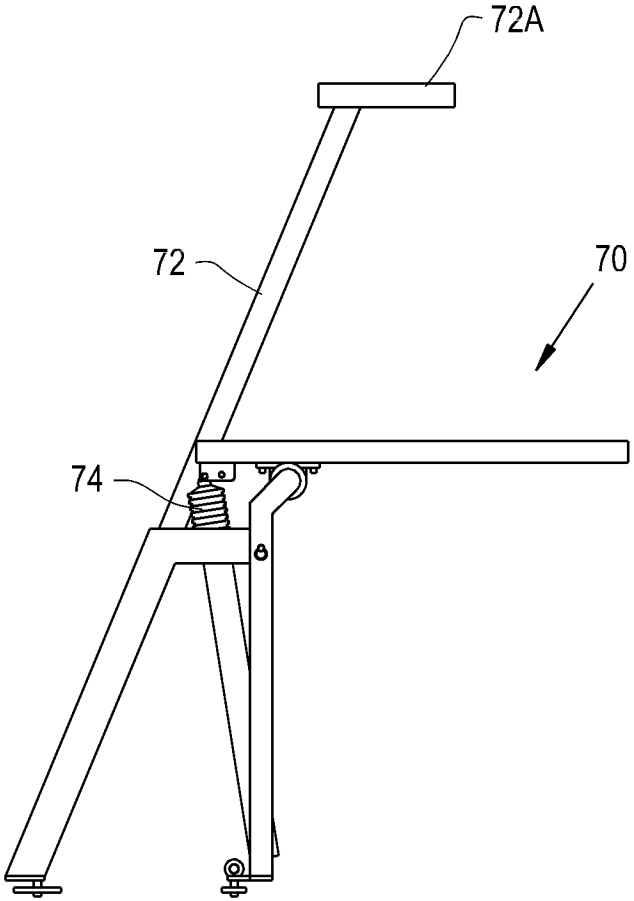
FIG. 10 is a rear view of a second embodiment of a diving board in accordance with the invention.
Figure 12:
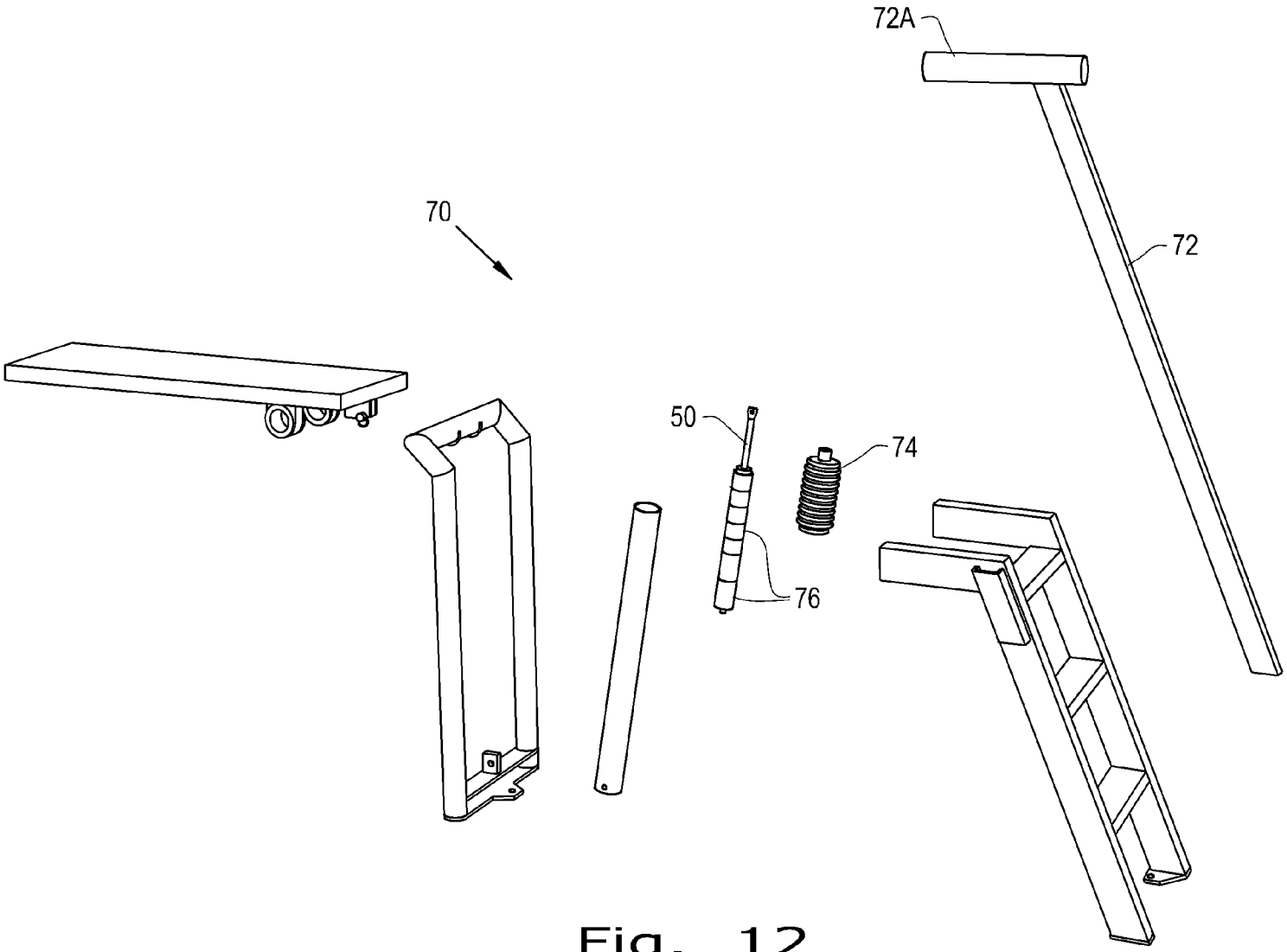
FIG. 12 is an exploded perspective view of the diving board shown in FIGS. 10 and 11.

A second embodiment of a diving board 70 in accordance with the invention is illustrated in FIGS. 10, 11 and 12. The diving board 70 is substantially similar to the diving board 12, except the second embodiment includes a circular handrail 72, a bellows 74, and urethane disks of two different diameters and thickness 76 (FIG. 12). A top portion 72A of the handrail 72 is cylindrical in shape, as to more ergonomically accommodate the diver. The bellows 74, acting as a protective covering, substantially encases the rod 50 (FIG. 10). The bellows 74 is made of a resilient material (e.g., rubber) and is able to extend or compress with the movement of the rod 50. The urethane disks of two different diameters and thickness 76 provide a variable counterbalance force, correlating to the weight of the diver. For instance, the urethane disks of two different diameters and thickness 76 may provide the diving board 70 to be preset for distinct weight limits. To attain a distinct weight limit, the sizing and placement, along the rod 50, of the urethane disks of two different diameters and thickness 76 may be altered within the scope of the invention.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A boat, comprising:

a frame; and a diving board mounted to said frame, said diving board including:

a base;

a board having a proximal end and a distal end, said board coupled to said base at a pivot location; and an axial spring interconnected between said base and said board for cancelling out forces which are imparted by a user jumping on said board at said distal end, wherein said axial spring has an upper end that is pivotally coupled to said board at a location ranging from said proximal end to said pivot location, said boat having a railing and said pivot location being positioned above said railing, said diving board being foldable at said pivot location to a stowed position alongside said railing.

2. The boat of claim 1, wherein said axial spring comprises a urethane spring, a coil spring or a gas spring.

3. The boat of claim 2, wherein said axial spring is a coil spring comprising one of a compression spring and a tension spring.

4. The boat of claim 2, wherein said axial spring is a gas spring comprising:

a cylinder;

a plurality of urethane disks stacked together within said cylinder, each said disk including a central opening with the openings of each disk aligned relative to each other; and a rod passing through said aligned openings, said rod having a lower end positioned below and engaging a bottom one of the urethane disks and an upper end extending through the cylinder and attached to said diving board.

5. The boat of claim 4, wherein said base includes a mounting plate, and said cylinder includes a bottom end connected to the mounting plate.

6. The boat of claim 1, wherein said board connects to said base by a plurality of couplers including plastic bearings at said pivot location.

7. The boat of claim 1, wherein said boat includes a flooring, and said base of the diving board includes a plurality of mounting plates attached to the flooring.

8. The boat of claim 7, further including a plurality of reinforcement plates positioned beneath said flooring, and a plurality of fasteners, each said fastener passing through an opening in a respective said mounting plate and connected with a respective said reinforcement plate.

9. The boat of claim 1, including a handrail with an upper end that is positioned above said board, and a lower end that is adjustably connected to said base.

10. The boat of claim 9, wherein said handrail connects to said base by a sleeve adjacent to the base, enabling the handrail to be variable in a height.

11. A diving board, comprising:

a base;

a board having a proximal end and a distal end, said board coupled to said base at a pivot location; and a gas spring interconnected between said base and said board for cancelling out forces which are imparted by a user jumping on said board at said distal end, wherein said gas spring has an upper end that is pivotally coupled to said board at a location ranging from said proximal end to said pivot location, said gas spring including:

a cylinder;

a plurality of urethane disks stacked together within said cylinder, each said disk including a central opening with the openings of each disk aligned relative to each other; and a rod passing through said aligned openings, said rod having a lower end positioned below and engaging a bottom one of the urethane disks and an upper end extending through the cylinder and attached to said diving board.

12. The diving board of claim 11, wherein said base includes a mounting plate, and said cylinder comprises a bottom end connected to the mounting plate.

13. The diving board of claim 11, wherein said board connects to said base by a plurality of couplers including plastic bearings at said pivot location.

14. The diving board of claim 11, including a handrail with an upper end that is positioned above said board, and a lower end that is adjustably connected to a sleeve adjacent to said base, enabling the handrail to be variable in a height.

15. A diving board, comprising:

a base;

a board having a proximal end and a distal end, said board coupled to said base at a pivot location; and an axial spring interconnected between said base and said board for cancelling out forces which are imparted by a user jumping on said board at said distal end, wherein said axial spring has an upper end that is pivotally coupled to said board at a location ranging from said proximal end to said pivot location, wherein said axial spring is pivotably connected to said base at a lower end thereof defining a lower axis and is pivotably connected to said board at said upper end thereof, and wherein said pivot location, said upper end of said axial spring, and said lower axis define a V-configuration, such that a top left point of the V-configuration is visualized by said pivot location, a top right point of the V-configuration is visualized by said upper end of said axial spring, and a bottom point of the V-configuration is visualized by said lower axis, which said V-configuration substantially cancels out forces acting on the diving board as a user jumps on the distal end of the board.

* * * * *